US010492276B2

(12) United States Patent
Sakagami et al.

(10) Patent No.: US 10,492,276 B2
(45) Date of Patent: Nov. 26, 2019

(54) LIGHTING CONTROL DEVICE, LIGHTING CONTROL METHOD, AND LIGHTING CONTROL PROGRAM

(71) Applicant: Pioneer DJ CORPORATION, Yokohama-shi, Kanagawa (JP)

(72) Inventors: Kei Sakagami, Yokohama (JP); Shiro Suzuki, Yokohama (JP); Hajime Yoshino, Yokohama (JP)

(73) Assignee: PIONEER DJ CORPORATION, Yokohama-Shi (JP)

( * ) Notice: Subject to any disclaimer, the term of this patent is extended or adjusted under 35 U.S.C. 154(b) by 0 days.

(21) Appl. No.: 16/099,556

(22) PCT Filed: May 12, 2016

(86) PCT No.: PCT/JP2016/064151
§ 371 (c)(1),
(2) Date: Nov. 7, 2018

(87) PCT Pub. No.: WO2017/195326
PCT Pub. Date: Nov. 16, 2017

(65) Prior Publication Data

US 2019/0090328 A1 Mar. 21, 2019

(51) Int. Cl.
*H05B 37/02* (2006.01)
*A63J 5/02* (2006.01)

(52) U.S. Cl.
CPC ..... *H05B 37/0236* (2013.01); *A63J 5/02* (2013.01)

(58) Field of Classification Search
CPC ..... H05B 37/0236; H05B 37/0245; H05B 37/0254; H05B 37/0263; H05B 37/0272
(Continued)

(56) References Cited

U.S. PATENT DOCUMENTS

2007/0008711 A1* 1/2007 Kim ..... H05B 37/0236 362/86
2011/0137757 A1* 6/2011 Paolini ..... G06Q 30/0641 705/27.1
(Continued)

FOREIGN PATENT DOCUMENTS

JP H10-149160 6/1998
JP 3743079 2/2006
(Continued)

OTHER PUBLICATIONS

English translation of International Preliminary Report on Patentability dated Nov. 13, 2018 (dated Nov. 13, 2018), Application No. PCT/JP2016/064151, 7 pages.
(Continued)

*Primary Examiner* — Tung X Le
(74) *Attorney, Agent, or Firm* — Rankin, Hill & Clark LLP

(57) ABSTRACT

A lighting controller configured to control a lighting fixture based on music piece data in which characteristic sections that characterize a music construction are allocated includes: a transition information acquisition unit configured to obtain transition information for each of the characteristic sections in the music piece data; a note-fractionated-section analyzing unit configured to analyze the characteristic section(s) in the music piece data to detect a note-fractionated section where a note is fractionated with progression of bars; and a lighting control data generating unit configured to generate lighting control data based on the transition information obtained by the transition information acquisition unit and the note-fractionated section detected by the note-fractionated-section analyzing unit.

12 Claims, 19 Drawing Sheets

(58) Field of Classification Search
USPC ..... 315/152, 307, 312
See application file for complete search history.

(56) References Cited

U.S. PATENT DOCUMENTS

| | | | | |
|---|---|---|---|---|
| 2015/0223576 | A1* | 8/2015 | Vora | A44C 15/0015 362/104 |
| 2018/0279429 | A1* | 9/2018 | Sadwick | H05B 33/08 |
| 2018/0336002 | A1* | 11/2018 | Hansen | H05B 37/0236 |

FOREIGN PATENT DOCUMENTS

| | | |
|---|---|---|
| JP | 2010-508626 | 3/2010 |
| JP | 2010-192155 | 9/2010 |

OTHER PUBLICATIONS

International Search Report, dated Aug. 9, 2016 (dated Aug. 9, 2016), 1 page.
Japanese Notice of Allowance dated Aug. 20, 2019, 1 page.

* cited by examiner

LIGHTING CONTROL DEVICE, LIGHTING CONTROL METHOD, AND LIGHTING CONTROL PROGRAM

TECHNICAL FIELD

The present invention relates to a lighting controller, a lighting control method, and a lighting control program.

BACKGROUND ART

In a concert and a night club, it is important for stage effects to match lighting with a music piece or change lighting in synchronization with a music piece.

In order to obtain an accurate stage effect by matching lighting with a music piece, a dedicated lighting staff having a good understanding of the music piece desirably manipulates a lighting device. However, it is difficult in terms of costs and the like that the dedicated lighting staff constantly stays in a small-sized concert, night club, event and the like.

In order to overcome this difficulty, automatic lighting control in conformity with a music piece has been suggested. For instance, according to the technique of Patent Literature 1 or 2, lighting control data relating to lighting contents matched with a music piece is generated in advance and lighting is controlled based on the lighting control data in synchronization with a music piece as the music piece is played, thereby achieving a desired lighting effect matched with the music piece.

In order to generate the lighting control data, music piece data being reproduced is analyzed in advance in terms of music construction and divided into characteristic sections (e.g., verse, pre-chorus, and chorus) that characterize the music construction, and a lighting pattern suitable to an image of each characteristic section is allocated for lighting.

CITATION LIST

Patent Literature(s)

Patent Literature 1: JP Patent No. 3743079
Patent Literature 2: JP 2010-192155 A

SUMMARY OF THE INVENTION

Problem(s) to be Solved by the Invention

Unfortunately, the techniques disclosed in Patent Literatures 1 and 2, which merely allow for lighting with a lighting pattern corresponding to each of the characteristic sections, cannot provide an effect that brings a sense of exaltation in a part of the characteristic section being currently reproduced for transition to the next characteristic section so that the next characteristic section can be expected. For instance, the above techniques are unlikely to achieve lighting that brings a sense of exaltation during the reproduction of the pre-chorus section followed by the chorus section, suggesting that the chorus section is coming soon.

An object of the invention is to provide a lighting controller, a lighting control method, and a lighting control program that allow for bringing a sense of exaltation in a part for transition to the next characteristic section so that the next characteristic section can be expected to come.

Means for Solving the Problem(s)

According to an aspect of the invention, a lighting controller configured to control a lighting fixture based on music piece data in which characteristic sections that characterize a music construction are allocated, the lighting controller includes: a transition information acquisition unit configured to obtain transition information for each of the characteristic sections in the music piece data; a note-fractionated-section analyzing unit configured to analyze at least one of the characteristic sections in the music piece data to detect a note-fractionated section where a note is fractionated with progression of bars; and a lighting control data generating unit configured to generate lighting control data based on the transition information obtained by the transition information acquisition unit and the note-fractionated section detected by the note-fractionated-section analyzing unit.

According to another aspect of the invention, a lighting controller configured to control a lighting fixture based on music piece data in which characteristic sections that characterize a music construction are allocated, the lighting controller includes: a transition information acquisition unit configured to obtain transition information for each of the characteristic sections in the music piece data; a level-varying-section analyzing unit configured to analyze at least one of the characteristic sections in the music piece data to detect a level-varying section where accumulation of an amplitude level per unit of time of a signal with a predetermined frequency or less falls within a predetermined range and accumulation of an amplitude level per unit of time of a signal with a frequency exceeding the predetermined frequency increases with progression of bars; and a lighting control data generating unit configured to generate lighting control data based on the transition information obtained by the transition information acquisition unit and the level-varying section detected by the level-varying-section analyzing unit.

According to still another aspect of the invention, a lighting controller configured to control a lighting fixture based on music piece data in which characteristic sections that characterize a music construction are allocated, the lighting controller includes: a transition information acquisition unit configured to obtain transition information for each of the characteristic sections in the music piece data; a fill-in-section analyzing unit configured to analyze at least one of the characteristic sections in the music piece data to detect a fill-in section where a peak level of a signal detected per beat varies; and a lighting control data generating unit configured to generate lighting control data based on the transition information obtained by the transition information acquisition unit and the fill-in section detected by the fill-in-section analyzing unit.

According to yet another aspect of the invention, a lighting control method of controlling a lighting fixture based on music piece data in which characteristic sections that characterize a music construction are allocated, the method includes: obtaining transition information for each of the characteristic sections in the music piece data; analyzing at least one of the characteristic sections in the music piece data to detect a note-fractionated section where a note is fractionated with progression of bars; and generating lighting control data based on the obtained transition information and the detected note-fractionated section.

According to a further aspect of the invention, a lighting control method of controlling a lighting fixture based on music piece data in which characteristic sections that characterize a music construction are allocated, the method includes: obtaining transition information for each of the characteristic sections in the music piece data; analyzing at least one of the characteristic sections in the music piece data to detect a level-varying section where accumulation of an amplitude level per unit of time of a signal with a predetermined frequency or less falls within a predetermined range and accumulation of an amplitude level per unit of time of a signal with a frequency exceeding the predetermined frequency increases with progression of bars; and generating lighting control data based on the obtained transition information and the detected level-varying section.

According to a still further aspect of the invention, a lighting control method of controlling a lighting fixture based on music piece data in which characteristic sections that characterize a music construction are allocated, the method includes: obtaining transition information for each of the characteristic sections in the music piece data; analyzing at least one of the characteristic sections in the music piece data to detect a fill-in section where a peak level of a signal detected per beat varies; and generating lighting control data based on the obtained transition information and the detected fill-in section.

According to a yet further aspect of the invention, a lighting control program is configured to enable a computer to function as the lighting controller.

BRIEF DESCRIPTION OF DRAWING(S)

Figure 5:
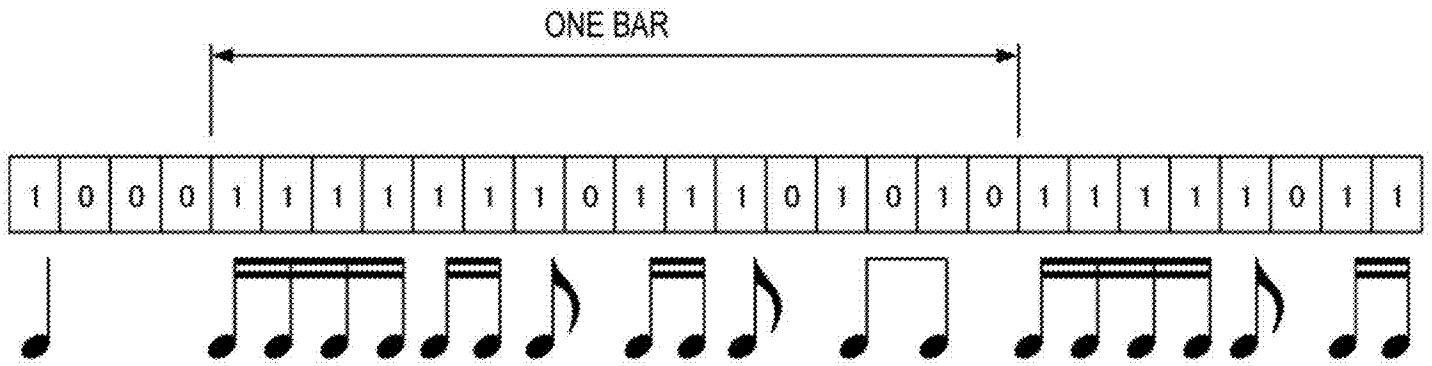

FIG. 5 schematically shows a state of a rhythm analysis result according to the exemplary embodiment.

Figure 6:
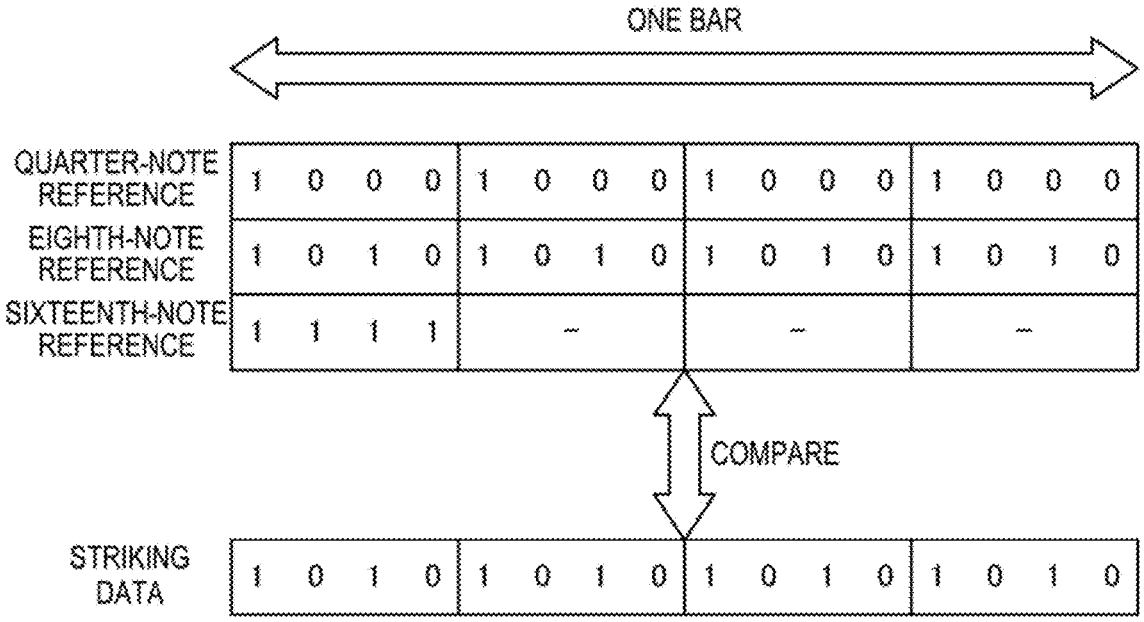

FIG. 6 is a schematic view for explaining a determination method of a note-fractionated section according to the exemplary embodiment.

Figure 7:
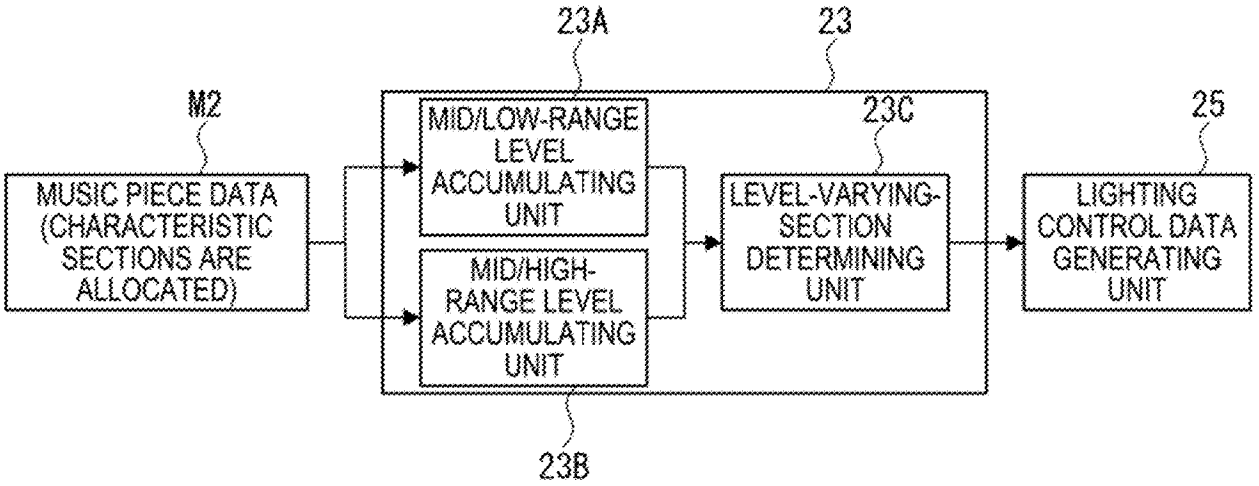

FIG. 7 is a block diagram showing a configuration of a level-varying-section analyzing unit according to the exemplary embodiment.

Figure 8:
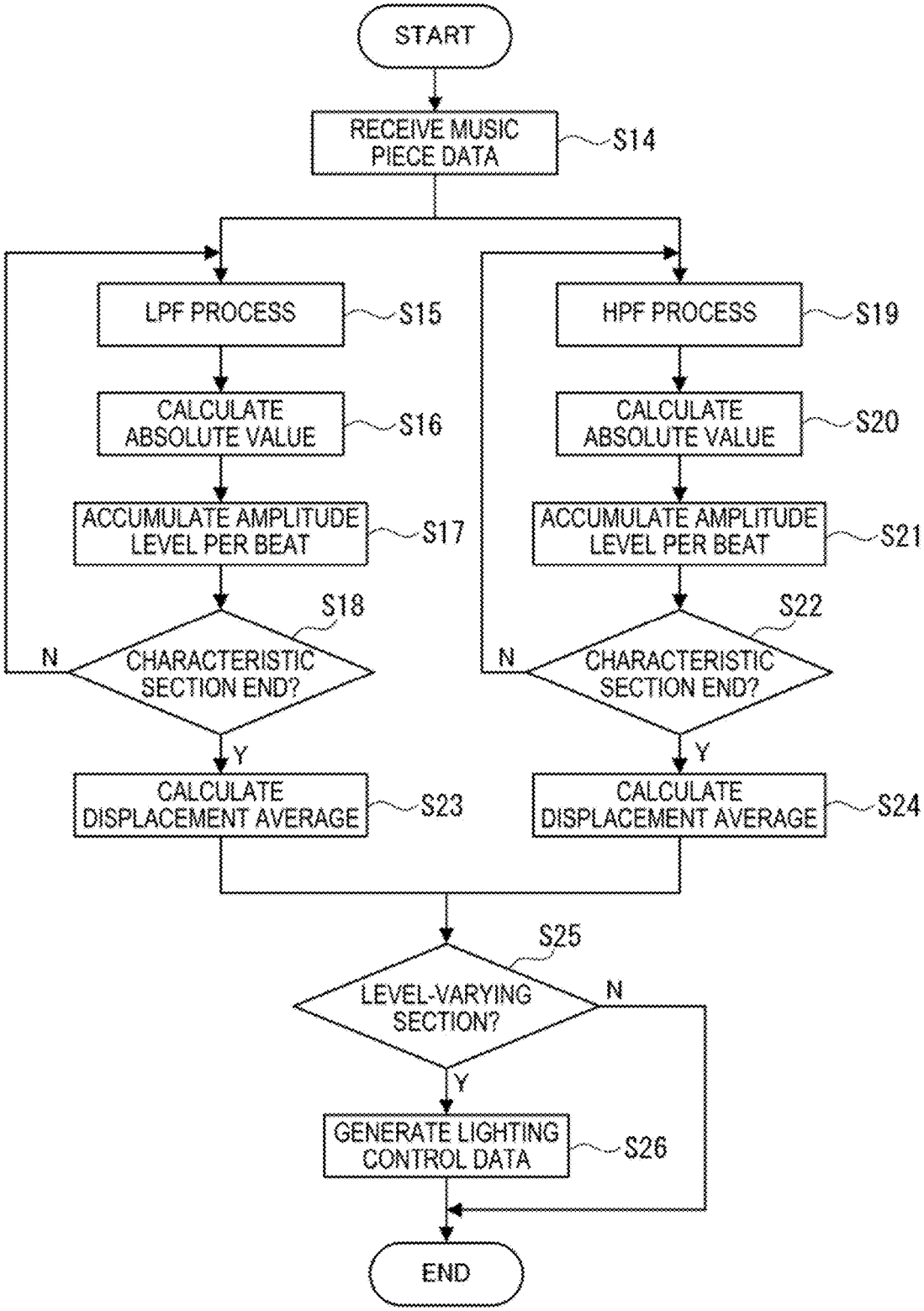

FIG. 8 is a flowchart showing an operation of the level-varying-section analyzing unit according to the exemplary embodiment.

Figure 9:
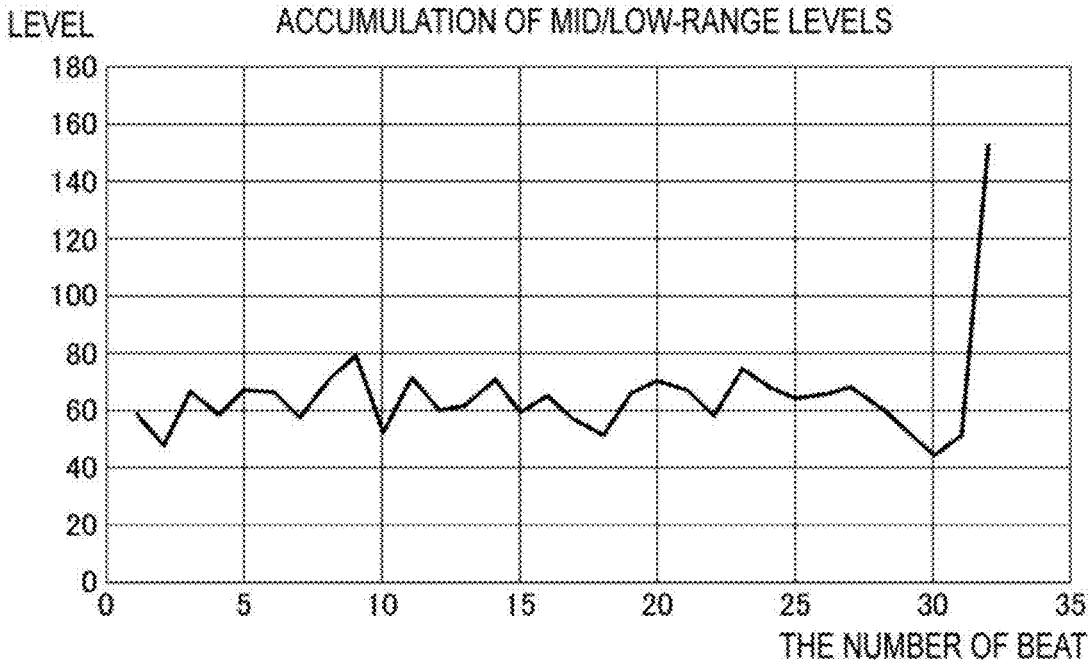

FIG. 9 is a graph for explaining a determination method of a level-varying section according to the exemplary embodiment.

Figure 10:
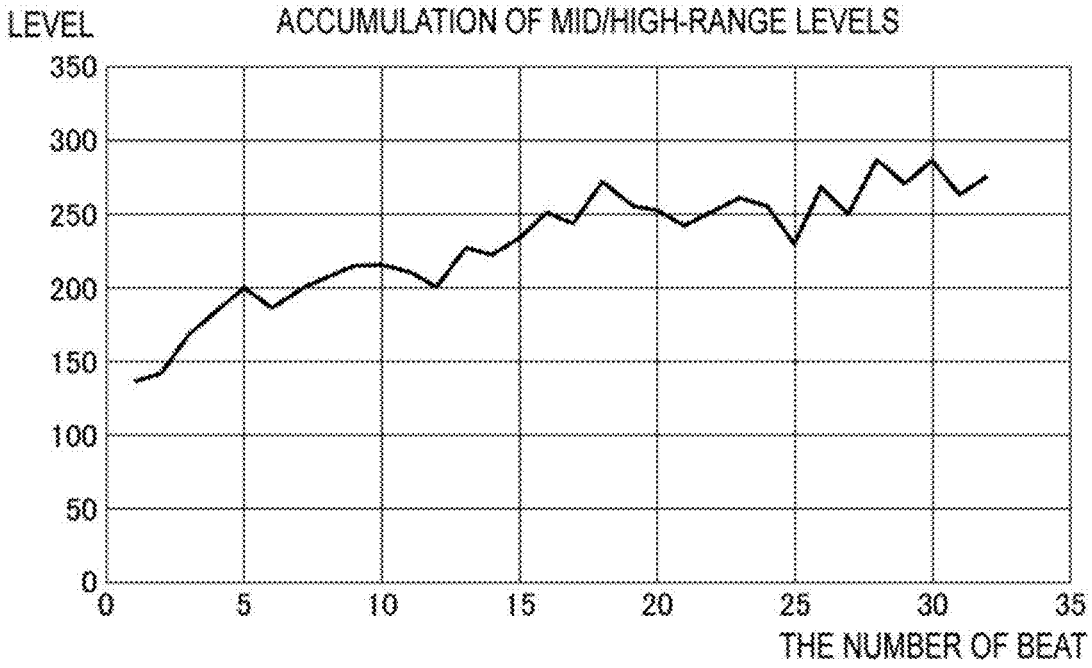

FIG. 10 is another graph for explaining the determination method of the level-varying section according to the exemplary embodiment.

Figure 11:
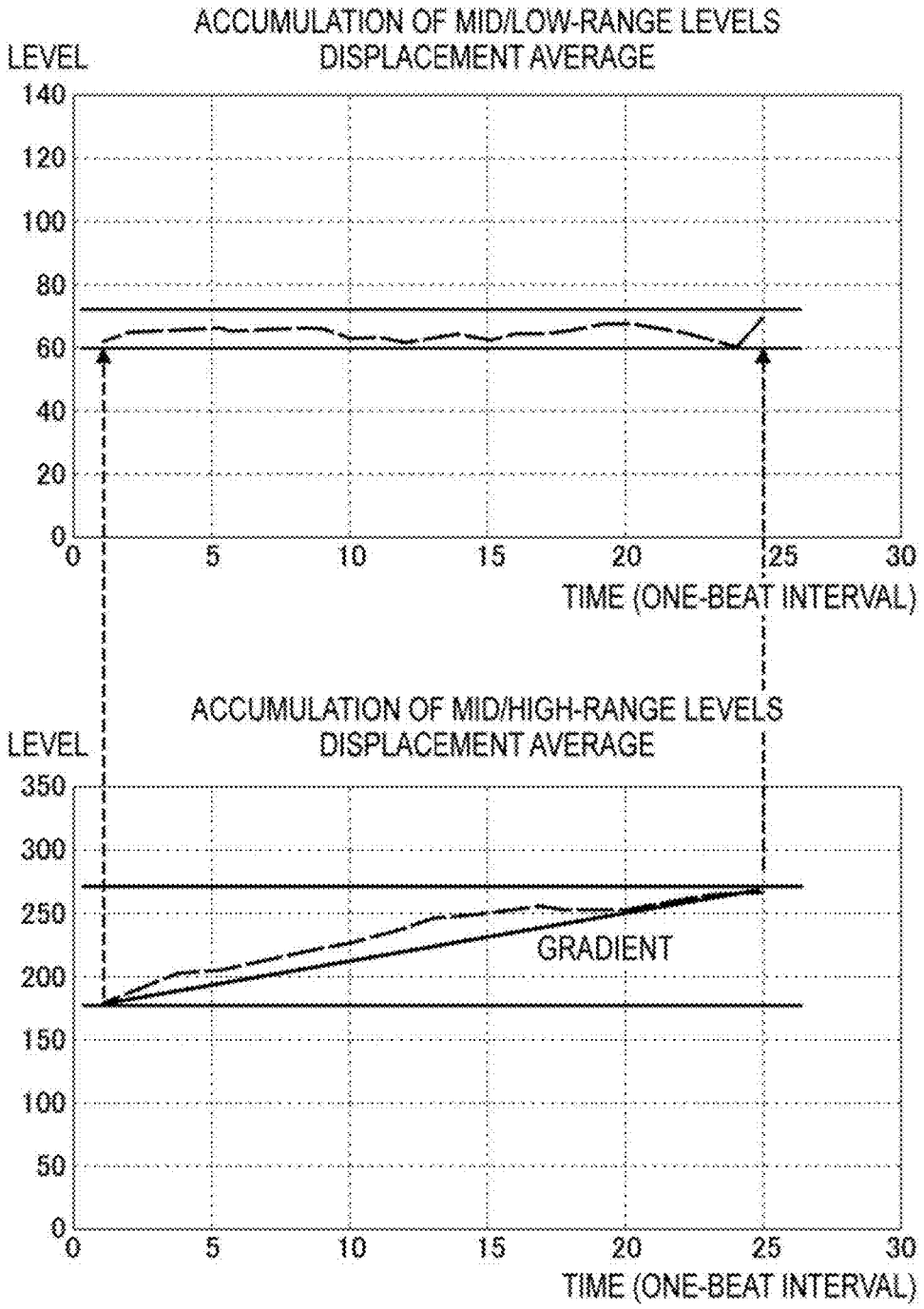

FIG. 11 is still another graph for explaining the determination method of the level-varying section according to the exemplary embodiment.

Figure 12:
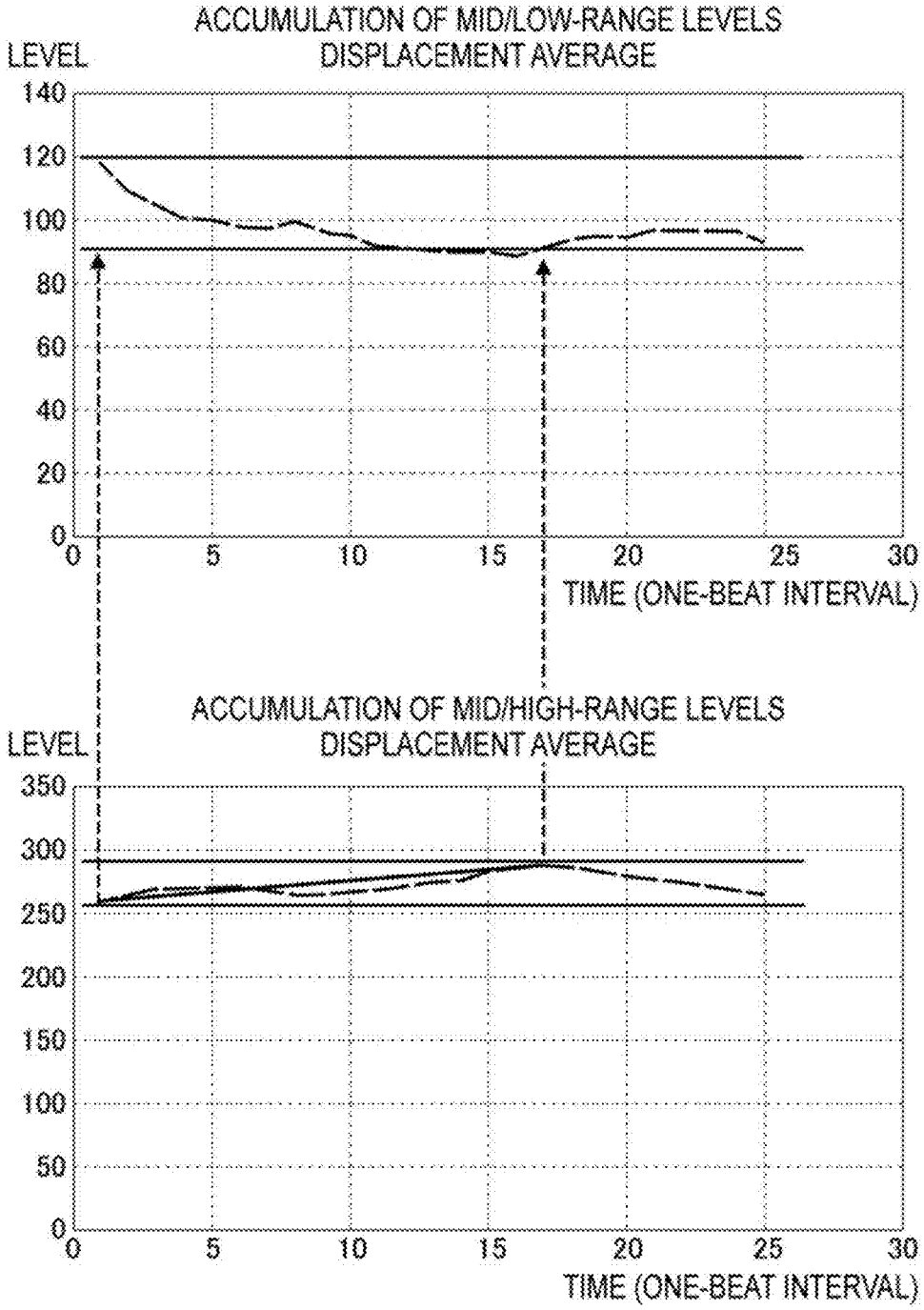

FIG. 12 is yet another graph for explaining the determination method of the level-varying section according to the exemplary embodiment.

Figure 13:
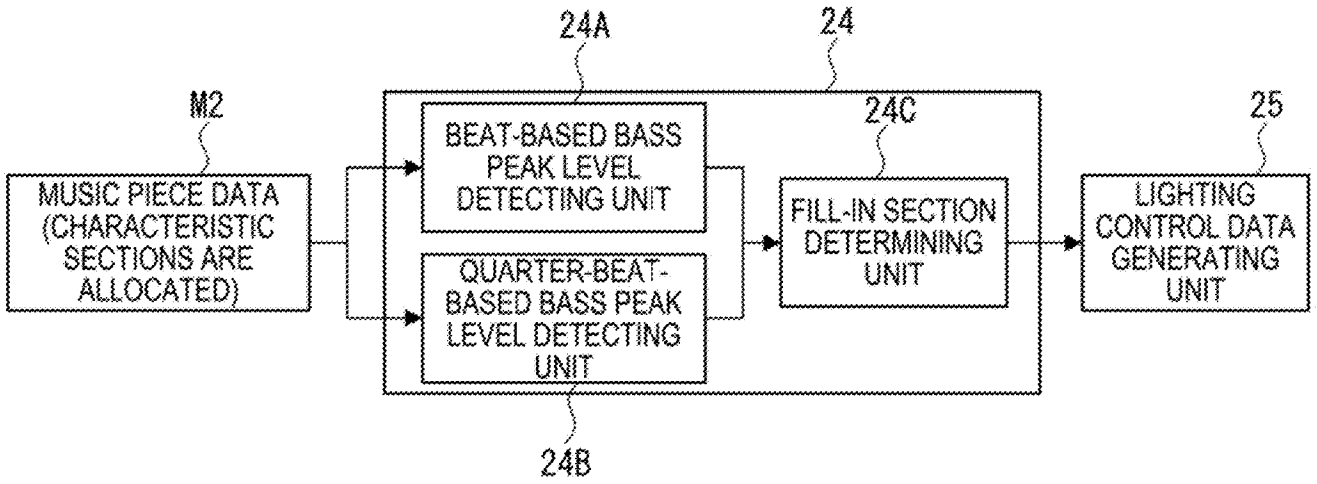

FIG. 13 is a block diagram showing a configuration of a fill-in-section analyzing unit according to the exemplary embodiment.

Figure 14:
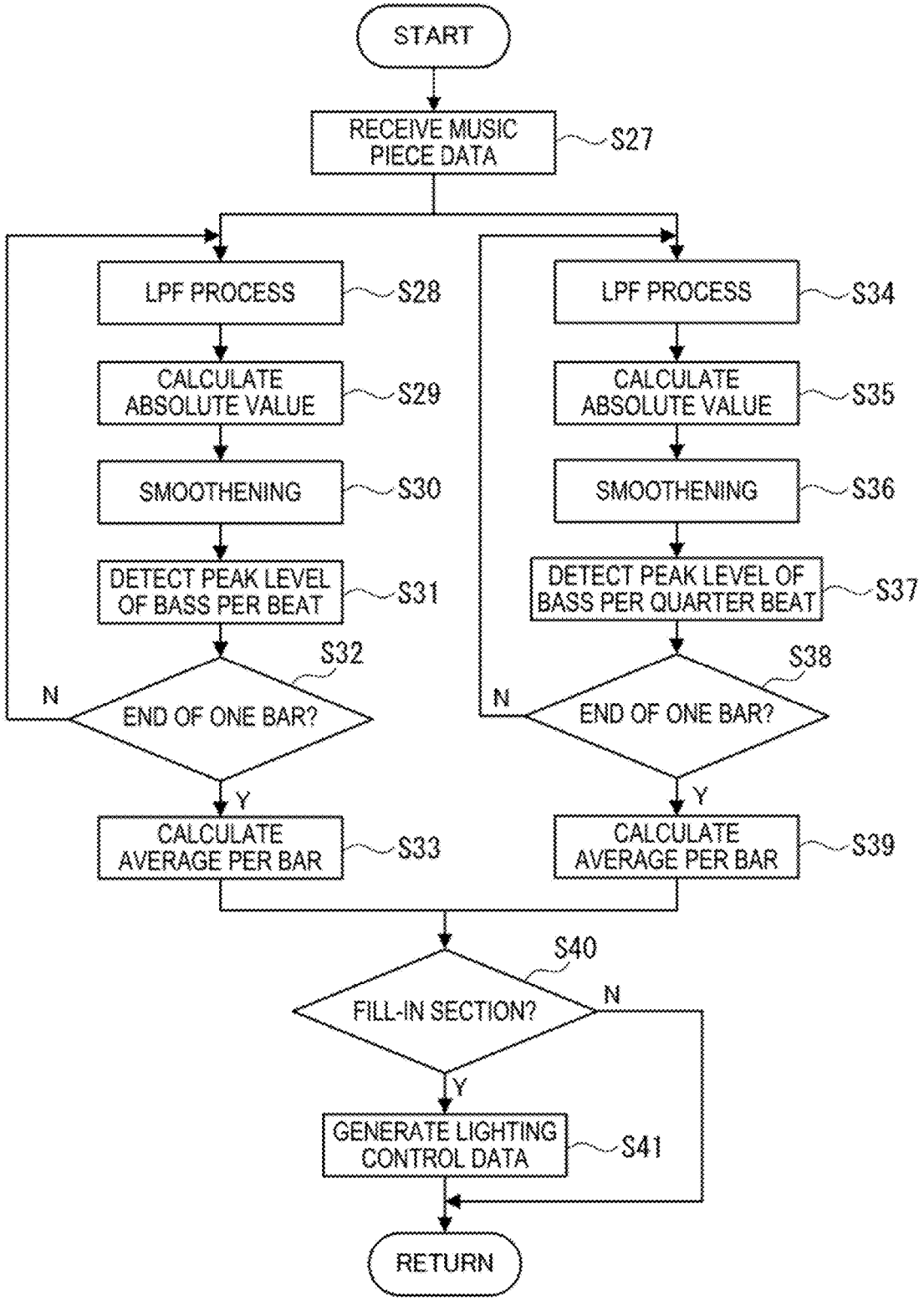

FIG. 14 is a flowchart showing an operation of the fill-in-section analyzing unit according to the exemplary embodiment.

Figure 15:
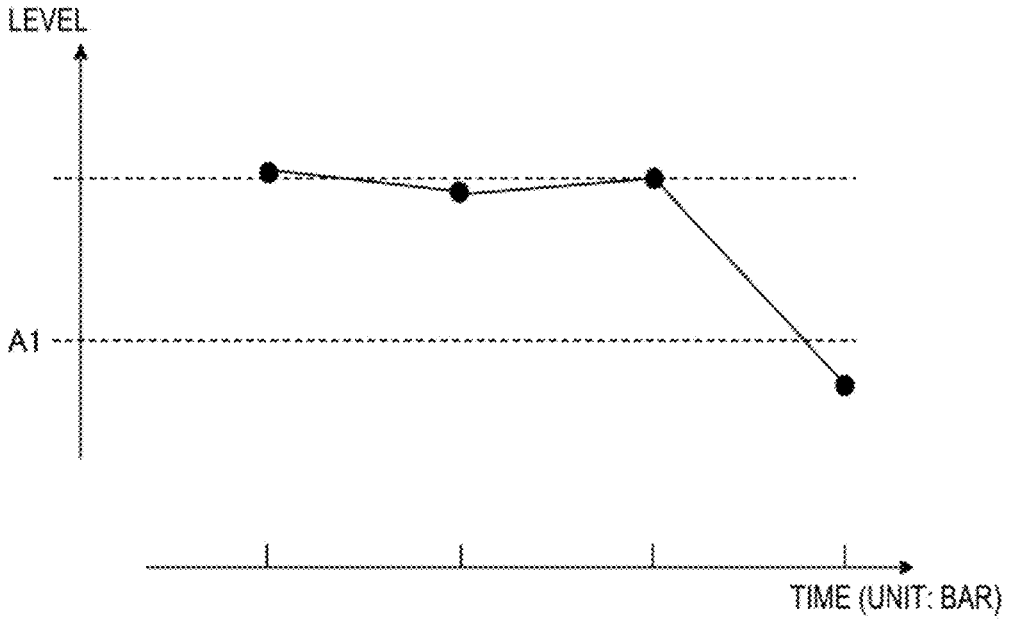

FIG. 15 is a graph for explaining a determination method of a fill-in section according to the exemplary embodiment.

Figure 16:
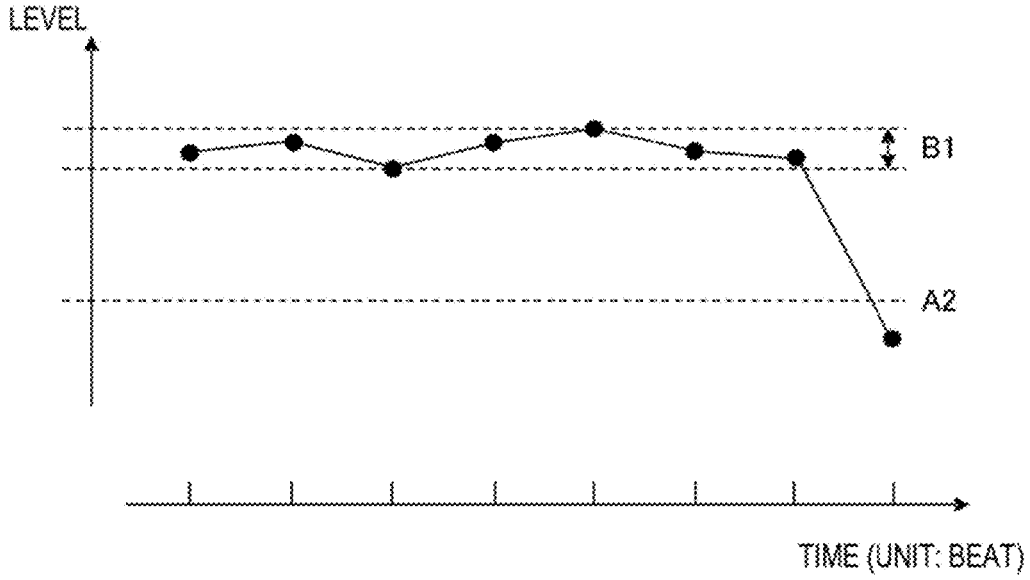

FIG. 16 is another graph for explaining the determination method of the fill-in section according to the exemplary embodiment.

Figure 17:
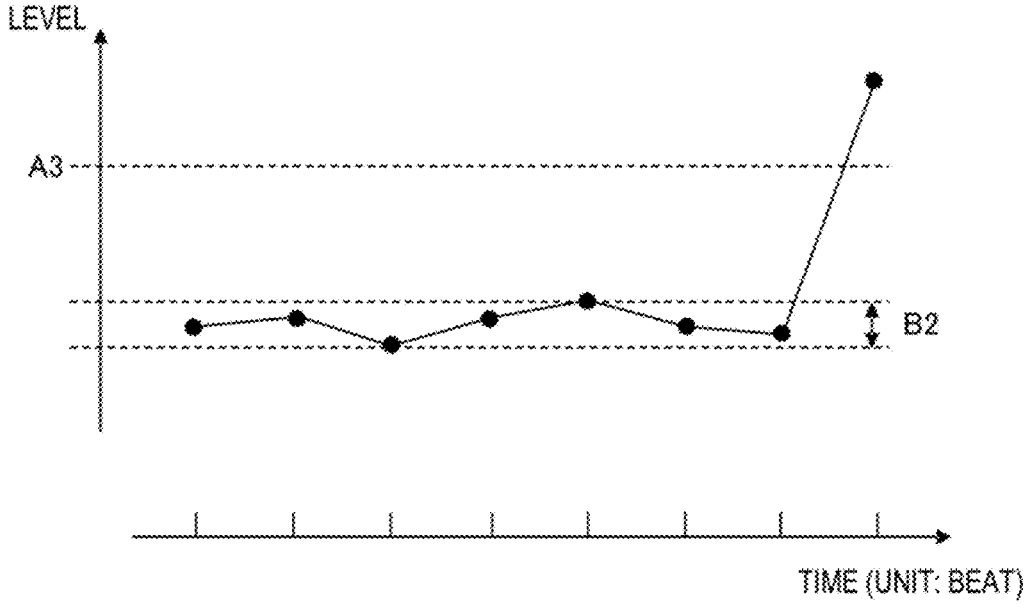

FIG. 17 is still another graph for explaining the determination method of the fill-in section according to the exemplary embodiment.

Figure 18:
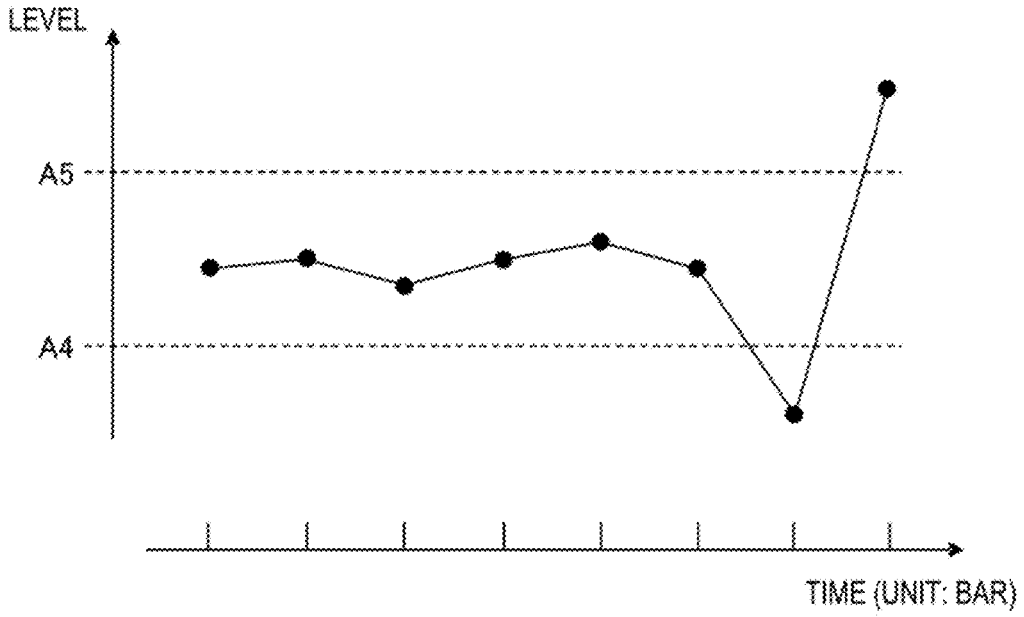

FIG. 18 is yet another graph for explaining the determination method of the fill-in section according to the exemplary embodiment.

Figure 19:
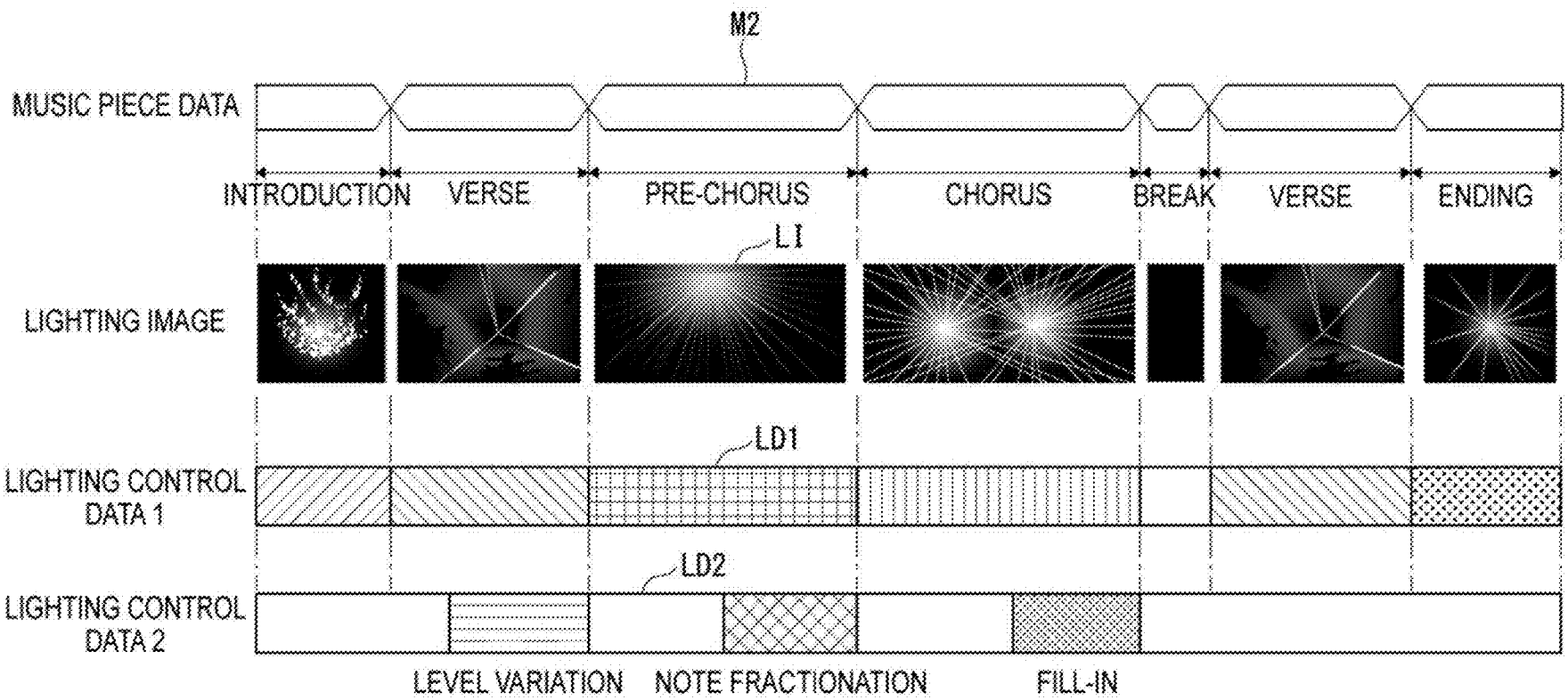

FIG. 19 schematically shows a relationship between each characteristic section in music piece data, a lighting image, and lighting control data according to the exemplary embodiment.

DESCRIPTION OF EMBODIMENT(S)

[1] Overall Configuration of Sound Control System 1 and Lighting System 10

Figure 1:
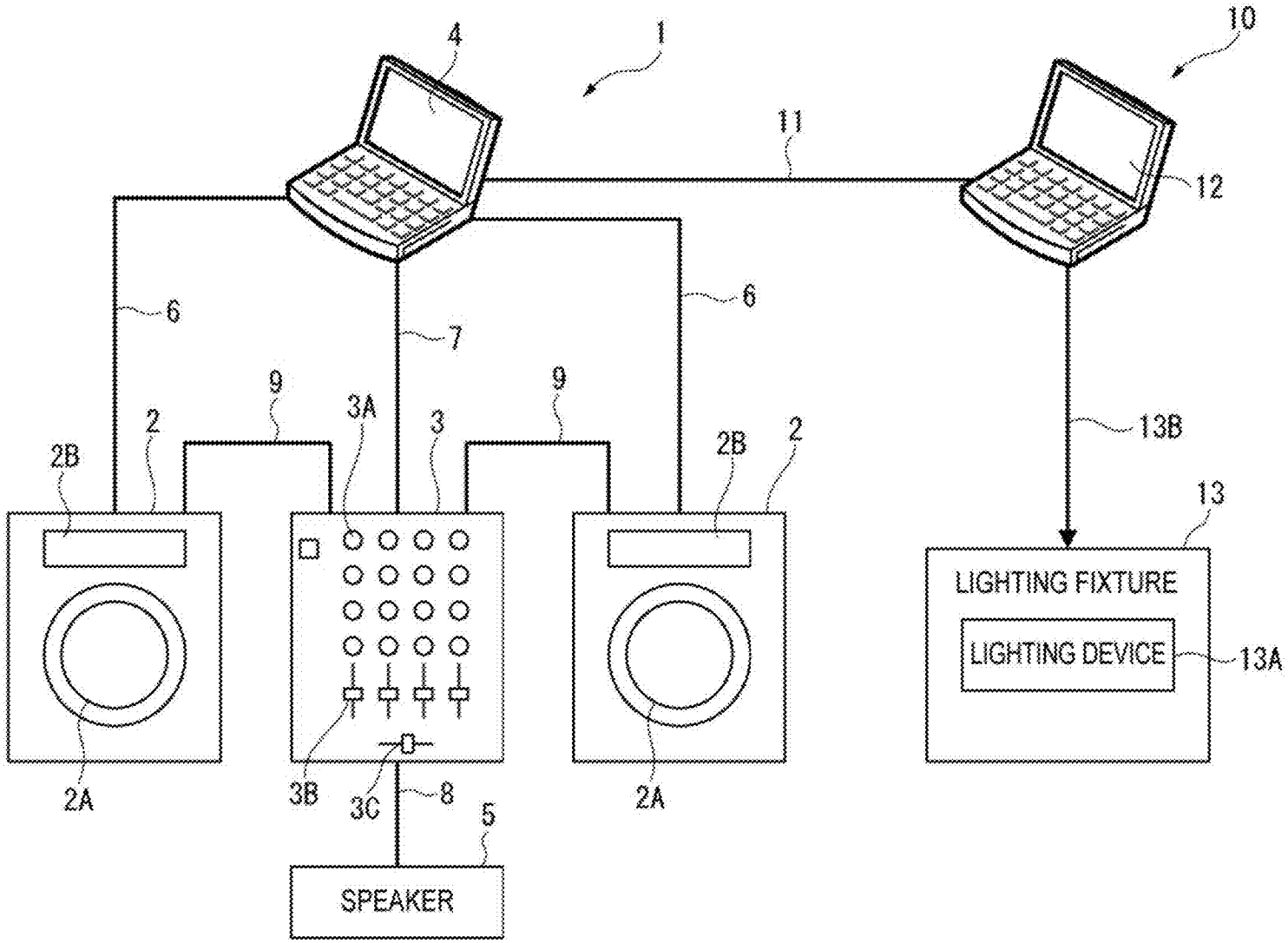
FIG. 1 is a block diagram showing a configuration of a sound control system and a lighting system according to an exemplary embodiment of the invention.

FIG. 1 shows a sound control system 1 and a lighting system 10 according to an exemplary embodiment of the invention, the sound control system 1 including two digital players 2, a digital mixer 3, a computer 4, and a speaker 5.

The digital players 2 each include a jog dial 2A, a plurality of operation buttons (not shown), and a display 2B. When a user of the digital players 2 operates the jog dial 2A and/or the operation button(s), sound control information corresponding to the operation is outputted. The sound control information is outputted to the computer 4 through a USB (Universal Serial Bus) cable 6 for bidirectional communication.

The digital mixer 3 includes a control switch 3A, a volume adjusting lever 3B, and a right-left switching lever 3C. Sound control information is outputted by operating these switch 3A and levers 3B, 3C. The sound control information is outputted to the computer 4 through a USB cable 7. Further, the digital mixer 3 is configured to receive music piece information processed by the computer 4. The music piece information, which is provided by an inputted digital signal, is converted into an analog signal and outputted in the form of sound from the speaker 5 through an analog cable 8.

Each of the digital players 2 and the digital mixer 3 are connected to each other through a LAN (Local Area Network) cable 9 compliant with the IEEE1394 standard, so that sound control information generated by operating the digital player(s) 2 can be outputted directly to the digital mixer 3 for DJ performance without using the computer 4.

The lighting system 10 includes a computer 12 connected to the computer 4 of the sound control system 1 through a USB cable 11 and a lighting fixture 13 configured to be controlled by the computer 12.

The lighting fixture 13, which provides lighting in a live-performance space and an event space, includes various lighting devices 13A frequently used as live-performance equipment.

Examples of the lighting devices 13A include a bar light, an electronic flash, and a moving head, which are frequently used for stage lighting. For each of the lighting devices 13A, parameters such as on and off of the lighting, brightness thereof, and, depending on the lighting device, an irradiation direction and a moving speed of the lighting device can be specified.

In order to control the above parameters, the lighting devices 13A of the lighting fixture 13, which comply with the DMX512 regulation, are connected to each other in accordance with the DMX512 regulation and lighting control signals 13B complying with the DMX512 regulation are sent to the lighting devices 13A to allow the lighting devices 13A to provide a desired lighting.

It should be noted that, although the DMX512 regulation is the common regulation in the field of stage lighting, the computer 12 and the lighting fixture 13 may comply with any other regulation.

[2] Arrangement of Functional Blocks of Sound Control System 1 and Lighting System 10

Figure 2:
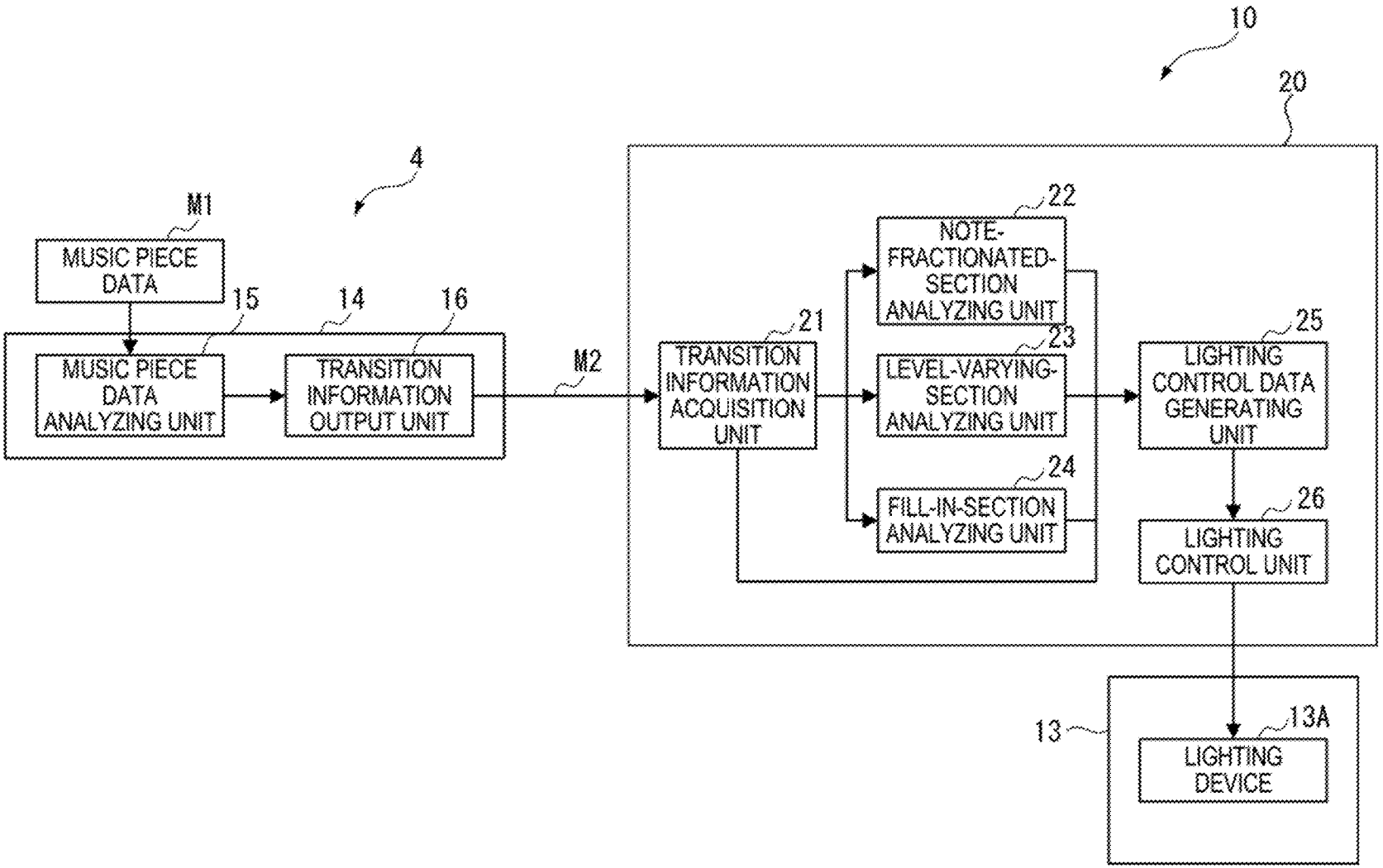
FIG. 2 is a block diagram showing the configuration of the sound control system and the lighting system according to the exemplary embodiment.

FIG. 2 shows a functional block diagram of the sound control system 1 and the lighting system 10 according to the exemplary embodiment.

The computer 4 of the sound control system 1 includes a music piece data analyzing unit 15 and a transition information output unit 16, each of which is provided by a computer program, configured to run on a processing unit 14 of the computer 4.

The music piece data analyzing unit 15 is configured to analyze inputted music piece data M1 and allocate characteristic sections, which characterize a music construction, to the music piece data M1. Examples of the characteristic sections being allocated include introduction section (Intro), verse section (Verse1), pre-chorus section (Verse2), chorus section (Hook), post-chorus section (Verse3), and ending section (Outro).

The music piece data M1 can be analyzed by a variety of methods. According to an exemplary method, the analysis may be performed by subjecting the music piece data M1 to FFT (Fast Fourier Transform) per bar, counting the number of notes per bar to determine transition points where the development (e.g., tone) of the characteristic section changes, and allocating the characteristic sections between the transition points with reference to the magnitudes of the numbers of notes. According to another exemplary method, the analysis may be performed by allocating the characteristic sections based on the similarity in, for instance, melody in the music piece data. The analysis result is outputted to the transition information output unit 16.

The transition information output unit 16 is configured to allocate the characteristic sections, which have been analyzed by the music piece data analyzing unit 15, in the music piece data M1 and outputs the data as allocated music piece data M2 to the computer 12 of the lighting system 10 through the USB cable 11.

[3] Arrangement of Functional Blocks and Operation of Lighting Controller

The computer 12 (lighting controller) includes a transition information acquisition unit 21, a note-fractionated-section analyzing unit 22, a level-varying-section analyzing unit 23, a fill-in-section analyzing unit 24, a lighting control data generating unit 25, and a lighting control unit 26, each of which is provided by a lighting control program configured to run on the processing unit 20.

The transition information acquisition unit 21 is configured to refer to the music piece data M2, which has been allocated with the characteristic sections and outputted from the computer 4, and obtain transition information of the characteristic sections in the music piece data M2. The obtained transition information of the characteristic sections is outputted to the note-fractionated-section analyzing unit 22, the level-varying-section analyzing unit 23, the fill-in-section analyzing unit 24, and the lighting control data generating unit 25.

Figure 3:
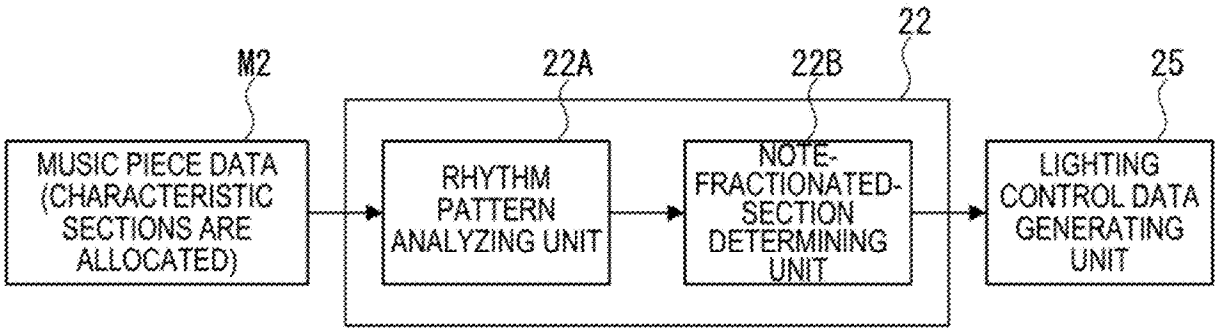
FIG. 3 is a block diagram showing a configuration of a note-fractionated-section analyzing unit according to the exemplary embodiment.

The note-fractionated-section analyzing unit 22 is configured to detect, among ones of the characteristic sections allocated in the music piece data M2 before the chorus section (i.e., introduction section, verse section, pre-chorus section), the characteristic section where the note intervals of the music piece data M2 are fractionated with the progression of bars to create a sense of exaltation in the characteristic section. As shown in FIG. 3, the note-fractionated-section analyzing unit 22 includes a rhythm pattern analyzing unit 22A and a note-fractionated-section determining unit 22B.

The rhythm pattern analyzing unit 22A is configured to obtain the number of strike notes in a bar in the characteristic section to detect an increase in the number of notes in the bar. For instance, the rhythm pattern analyzing unit 22A is configured to detect a change from 4 strikes in quarter note to 8 strikes in eighth note or 16 strikes in sixteenth note in a bar.

Figure 4:
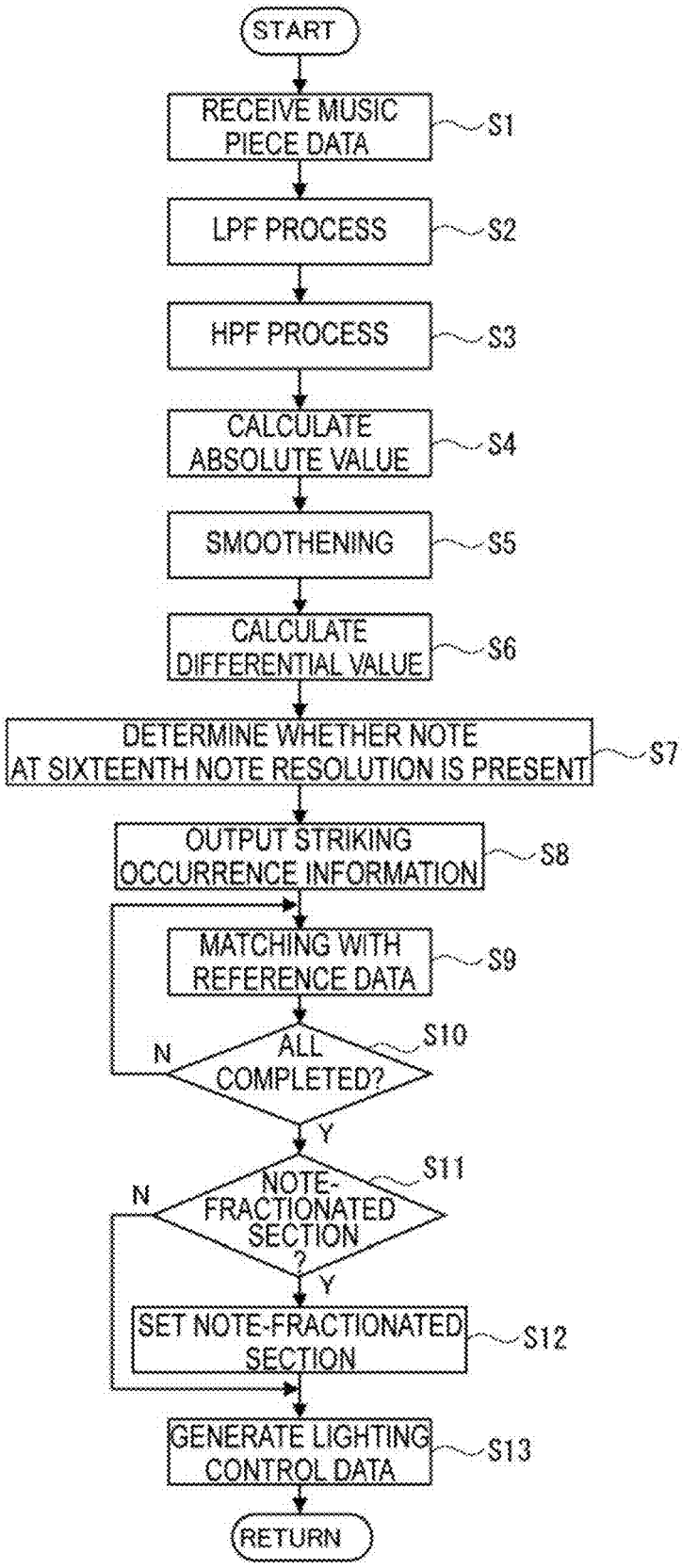
FIG. 4 is a flowchart showing an operation of the note-fractionated-section analyzing unit according to the exemplary embodiment.

As shown in the flowchart in FIG. 4, the rhythm pattern analyzing unit 22A receives the music piece data M2 (Step S1).

Subsequently, the rhythm pattern analyzing unit 22A filters the music piece data M2 with LPF (Low Pass Filter) to obtain only a low frequency component such as bass drum note and base note in the music piece data M2 (Step S2). Further, the rhythm pattern analyzing unit 22A further performs filtering with HPF (High Pass Filter) to eliminate a noise component and performs full-wave rectification by absolute value calculation (Step S4).

The rhythm pattern analyzing unit 22A performs further filtering with secondary LPF to smoothen the signal level (Step S5).

The rhythm pattern analyzing unit 22A calculates a differential value of the signal having been smoothened to detect an attack of the low frequency component (Step S6).

The rhythm pattern analyzing unit 22A determines whether a note at a sixteenth note resolution is present with reference the attack of the low frequency component (Step S7). Specifically, the rhythm pattern analyzing unit 22A determines whether an attack note is present (attack note is present: 1/no attack note is present: 0) as shown in FIG. 5.

After the determination of the presence of the note, the rhythm pattern analyzing unit 22A outputs the determination result as striking occurrence information to the note-fractionated-section determining unit 22B (Step S8).

The note-fractionated-section determining unit 22B determines a note-fractionated section in the characteristic sections based on the striking occurrence information determined by the rhythm pattern analyzing unit 22A (Step S9).

Specifically, as shown in FIG. 6, the note-fractionated-section determining unit 22B, which has stored reference data for each of quarter note, eighth note, and sixteenth note, determines whether striking data inputted per bar is the same as the reference data (matching).

The note-fractionated-section determining unit 22B performs the above matching with the reference data on each of the bars in the characteristic section (Step S10).

Subsequently, the note-fractionated-section determining unit 22B determines whether the characteristic section is a note-fractionated section based on the matching result (Step S11).

Further, when determining that the characteristic section is the note-fractionated section, the note-fractionated-section determining unit 22B sets the characteristic section as the note-fractionated section (Step S12) and the lighting control data generating unit 25 generates lighting control data corresponding to the note-fractionated section (Step S13).

The level-varying-section analyzing unit 23 detects, in the music piece data M2 allocated with the characteristic sections, a part with an increase in sweep sound and/or high frequency noise as a section that increases a sense of tension, i.e., a level-varying section.

As shown in FIG. 7, the level-varying-section analyzing unit 23 includes a mid/low-range level accumulating unit 23A, a mid/high-range level accumulating unit 23B, and a level-varying-section determining unit 23C.

For the sweep sound and/or high frequency noise in the music piece data M2, the mid/low-range level accumulating unit 23A is configured to detect an amplitude level of a signal with a predetermined frequency (e.g., 500 Hz) or less and obtain an accumulated value(s) thereof.

For the sweep sound and/or high frequency noise in the music piece data M2, the mid/high-range level accumulating unit 23B is configured to detect an amplitude level of a signal with a frequency exceeding the predetermined frequency and obtain an accumulated value(s) thereof.

Based on the detection result by the mid/low-range level accumulating unit 23A and the detection result by the mid/high-range level accumulating unit 23B, the level-varying-section determining unit 23C is configured to determine whether the target characteristic section is the level-varying section.

Specifically, the level-varying-section determining unit 23C is configured to determine that the target section is the level-varying section when accumulated amplitude levels per unit of time of the signal with the predetermined frequency or less falls within a predetermined range and accumulated amplitude levels per unit of time of the signal with the frequency exceeding the predetermined frequency increases with the progression of bars.

The mid/low-range level accumulating unit 23A, the mid/high-range level accumulating unit 23B, and the level-varying-section determining unit 23C detect the level-varying section based on the flowchart shown in FIG. 8.

When receiving the music piece data M2 allocated with the characteristic sections (Step S14), the mid/low-range level accumulating unit 23A performs the LPF process (Step S15).

After the LPF process, the mid/low-range level accumulating unit 23A calculates an absolute value to perform full-wave rectification (Step S16) and accumulates the amplitude level of the signal per beat (Step S17).

The mid/low-range level accumulating unit 23A accumulates the amplitude level of the signal for each of the characteristic sections (Step S18) and, after the completion of the accumulation, outputs the accumulated values of the amplitude level of the signal corresponding to the number of beats to the level-varying-section determining unit 23C as shown in FIG. 9.

The mid/high-range level accumulating unit 23B runs in parallel with the mid/low-range level accumulating unit 23A. When receiving the music piece data M2 allocated with the characteristic sections (Step S14), the mid/high-range level accumulating unit 23B performs the HPF process (Step S19).

After the HPF process, the mid/high-range level accumulating unit 23B calculates an absolute value to perform full-wave rectification (Step S20) and accumulates the amplitude level of the signal per beat (Step S21).

The mid/high-range level accumulating unit 23B accumulates the amplitude level of the signal for each of the characteristic sections (Step S22) and, after the completion of the accumulation, outputs the accumulated values of the amplitude level of the signal corresponding to the number of beats to the level-varying-section determining unit 23C as shown in FIG. 10.

The level-varying-section determining unit 23C calculates a displacement average based on the mid/low-range level accumulated values outputted from the mid/low-range level accumulating unit 23A (Step S23) and calculates a displacement average based on the mid/high-range level accumulated values outputted from the mid/high-range level accumulating unit 23B (Step S24).

The level-varying-section determining unit 23C determines whether the target characteristic section is the level-varying section based on the displacement averages (Step S25).

Specifically, as shown in FIG. 11, the level-varying-section determining unit 23C determines that the target characteristic section contains the level-varying section when: the displacement average of the mid/low-range level accumulated values falls within a predetermined range until the number of beats reaches a predetermined value; and the displacement average of the mid/high-range level accumulated values exceeds the predetermined range with a gradient increasing beyond a predetermined threshold before the number of beats reaches the predetermined value. This is because a high frequency component in a sweep sound increases with the progression of beats, thus allowing the sweep sound to be determined, and because a gradual increase in a high frequency noise increases the volume of a mid/high-range level sound, bringing a change with a sense of tension.

In contrast, as shown in FIG. 12, the level-varying-section determining unit 23C determines that the target characteristic section contains no level-varying section when the displacement average of the mid/low-range level accumulated values and the displacement average of the mid/high-range level accumulated values each vary within the predetermined range.

When determining that the target characteristic section is the level-varying section, the level-varying-section determining unit 23C sets the target characteristic section as the level-varying section and the lighting control data generating unit 25 generates lighting control data corresponding to the level-varying section (Step S26).

The fill-in-section analyzing unit 24 is configured to detect, in the music piece data M2 allocated with the characteristic sections, the section(s) where bass drum note or base note stops for a predetermined time and/or, for instance, rolling of a snare drum or a tom-tom is filled in as a precursory section before the progression to the chorus section, i.e., as a fill-in section, on a basis of beat.

As shown in FIG. 13, the fill-in-section analyzing unit 24 includes a beat-based bass peak level detecting unit 24A, a quarter-beat-based bass peak level detecting unit 24B, and fill-in-section determining unit 24C.

The beat-based bass peak level detecting unit 24A is configured to detect a peak level of a signal representing bass per beat with reference to an initial beat position (start point) in the music piece data M2 in order to detect the fill-in section per beat, where a peak level of a signal representing, for instance, bass drum or base varies. For instance, the beat-based bass peak level detecting unit 24A is configured to detect the section where a bass drum note or a base note temporarily stops as the fill-in section.

The quarter-beat-based bass peak level detecting unit 24B is configured to detect a peak level of a signal representing bass per quarter beat with reference to the initial beat position (start point) in the music piece data M2 in order to detect the fill-in section, in which a snare drum note, a tom-tom note or the like is filled in, at a beat-based position. For instance, the quarter-beat-based bass peak level detecting unit 24B is configured to detect the section where a snare drum or a tom-tom is temporarily rolled as the fill-in section.

The fill-in-section determining unit 24C is configured to determine whether the target section is the fill-in section based on the detection result of the fill-in section from each of the beat-based bass peak level detecting unit 24A and the quarter-beat-based bass peak level detecting unit 24B.

Specifically, the beat-based bass peak level detecting unit 24A, the quarter-beat-based bass peak level detecting unit 24B, and the fill-in-section determining unit 24C detect the fill-in section based on the flowchart shown in FIG. 14.

When receiving the music piece data M2 allocated with the characteristic sections (Step S27), the beat-based bass peak level detecting unit 24A performs the LPF process (Step S28).

The beat-based bass peak level detecting unit 24A calculates an absolute value of a signal level to perform full-wave rectification (Step S29) and smoothen the signal level (Step S30).

The beat-based bass peak level detecting unit 24A detects a peak level of bass per beat from the smoothened signal level (Step S31) and repeats the above process until the end of one bar (Step S32).

At the completion of the detection of the signal level for one bar, the beat-based bass peak level detecting unit 24A calculates an average of the beat-based peak levels per bar (Step S33) and outputs the average to the fill-in-section determining unit 24C.

The quarter-beat-based bass peak level detecting unit 24B performs the process in parallel with the beat-based bass peak level detecting unit 24A When receiving the music piece data M2 allocated with the characteristic sections (Step S27), the quarter-beat-based bass peak level detecting unit 24B performs the LPF process (Step S34).

The quarter-beat-based bass peak level detecting unit 24B calculates an absolute value of a signal level to perform full-wave rectification (Step S35) and smoothen the signal level (Step S36).

The quarter-beat-based bass peak level detecting unit 24B detects a peak level of bass per quarter beat from the smoothened signal level (Step S37) and repeats the above process until the end of one bar (Step S38).

At the completion of the detection of the signal level for one bar, the quarter-beat-based bass peak level detecting unit 24B calculates an average of the quarter-beat-based peak levels per bar (Step S39) and outputs the average to the fill-in-section-determining unit 24C The fill-in-section determining unit 24C determines whether the target characteristic section is the fill-in section based on the average of the peak levels of bass per beat outputted from the beat-based bass peak level detecting unit 24A and the average of the peak levels of bass per quarter beat outputted from the quarter-beat-based bass peak level detecting unit 24B (Step S40).

Specifically, the fill-in-section determining unit 24C determines that the target characteristic section is the fill-in section when the following conditions are satisfied.

Condition 1

As shown in FIG. 15, referring to the respective averages of the beat-based peak levels of bass in the last four bars in the target section, the average of the beat-based peak levels of bass of one (and, if any, subsequent one(s)) of the last several beats (e.g., four beats or one bar) is smaller than a predetermined value A1.

Condition 2

As shown in FIG. 16, the respective averages of the quarter-beat-based peak levels of bass in the last four bars in the target section fall within a predetermined range B1 and the average of the quarter-beat-based peak levels of bass of one (and, if any, subsequent one(s)) of the last several beats (e.g., four beats or one bar) is smaller than a predetermined value A2.

Condition 3

As shown in FIG. 17, the respective averages of the quarter-beat-based peak levels of bass in the last four bars in the target section fall within a predetermined range B2 and the average of the quarter-beat-based peak levels of bass of one (and, if any, subsequent one(s)) of the last several beats (e.g., four beats or one bar) is larger than a predetermined value A3.

Condition 4

As shown in FIG. 18, the average of the beat-based peak levels of bass immediately before the last one in the target section is smaller than a predetermined value A4 and the average of the beat-based peak level of bass of one (and, if any, subsequent one(s)) of the last several beats (e.g., four beats or one bar) is larger than a predetermined value A5.

The lighting control data generating unit 25 generates the lighting control data based on the note-fractionated-section detected by the note-fractionated-section analyzing unit 22, the level-varying section detected by the level-varying-section analyzing unit 23, and the fill-in section detected by the fill-in-section analyzing unit 24.

As shown in FIG. 19, the lighting control data generating unit 25 first allocates corresponding lighting control data LD1 to each of the characteristic sections, such as the introduction section, the verse section, the pre-chorus section, and the chorus section, in the music piece data M2 allocated with the characteristic sections.

Subsequently, based on the detected note-fractionated-section, level-varying section, and fill-in section, the lighting control data generating unit 25 allocates lighting control data LD2 to ones of the characteristic sections containing these sections in an overlapping manner.

For instance, for the note-fractionated-section, the lighting control data generating unit 25 generates a piece of lighting control data that achieves a lighting effect where light blinks in response to sixteenth-note striking. A changing point of the lighting effect is a starting point of a change in a bass drum attack from eighth note to sixteenth note.

For the level-varying section, the lighting control data generating unit 25 generates a piece of lighting control data that achieves a lighting effect where light brightness increases with an increase in sweep sound or high frequency noise.

For the fill-in section, the lighting control data generating unit 25 generates a piece of lighting control data that achieves a lighting effect where light brightness gradually drops. A changing point of the lighting effect is a starting point of the fill-in section.

It should be noted that the above pieces of lighting control data are not exhaustive and the lighting control data generating unit 25 may generate a different piece of lighting control data depending on a change in the music piece data M2.

The lighting control data generating unit 25 outputs the generated lighting control data to the lighting control unit 26.

In the exemplary embodiment, the lighting control data generated by the lighting control data generating unit 25 is in the form of data for a DMX control software processable by the lighting control unit 26. It should be noted that the lighting control unit 26 according to the exemplary embodiment is a DMX control software configured to run in the computer 12 but may be a hardware controller connected to the computer 12.

The lighting control unit 26 controls the lighting fixture 13 based on the lighting control data outputted from the lighting control data generating unit 25, achieving lighting shown by a lighting image LI in FIG. 19.

Here, the verse section contains the level-varying section, which is provided with an effect where the brightness of the lighting image LI gradually increases. Further, the pre-chorus section contains the note-fractionated-section, which is provided with an effect where the lighting image LI blinks in response to striking a drum or plucking a string of a base. Further, the chorus section is provided with an effect where the brightness of the lighting image LI gradually drops when fill-in starts.

Advantage(s) of Exemplary Embodiment(s)

According to the exemplary embodiment, the note-fractionated-section analyzing unit 22, which is configured to control the lighting for the note-fractionated-section, allows for providing an effect that brings a sense of exaltation during the lighting control for the pre-chorus section followed by the chorus section so that the chorus section can be expected to come.

Further, the level-varying-section analyzing unit 23 allows for providing an effect that brings a sense of exaltation during the lighting control for the verse section followed by the pre-chorus section so that the pre-chorus section can be expected to come.

Further, the fill-in-section analyzing unit 24 allows for making the end of the chorus section expectable, that is, providing an effect that brings a sense of exaltation during the lighting control for the chorus section so that the next development in the music piece can be expected.

The invention claimed is:

1. A lighting controller configured to control a lighting fixture based on music piece data in which characteristic sections that characterize a music construction are allocated, the lighting controller comprising:

a transition information acquisition unit configured to obtain transition information for each of the characteristic sections in the music piece data;

a note-fractionated-section analyzing unit configured to analyze at least one of the characteristic sections in the music piece data to detect a note-fractionated section where a note interval is fractionated with progression of bars by analyzing a rhythm pattern of a note; and a lighting control data generating unit configured to generate lighting control data based on the transition information obtained by the transition information acquisition unit and the note-fractionated section detected by the note-fractionated-section analyzing unit.

2. The lighting controller according to claim 1, wherein the lighting control data generating unit is configured to set a starting point of the detected note-fractionated section as a changing point of a lighting effect.

3. A computer-readable medium that stores a program code configured to enable a computer to function as the lighting controller according to claim 1 when read and run by the computer.

4. A lighting controller configured to control a lighting fixture based on music piece data in which characteristic sections that characterize a music construction are allocated, the lighting controller comprising:

a transition information acquisition unit configured to obtain transition information for each of the characteristic sections in the music piece data;

a level-varying-section analyzing unit configured to analyze at least one of the characteristic sections in the music piece data to detect a level-varying section where accumulation of an amplitude level per unit of time of a signal with a predetermined frequency or less falls within a predetermined range and accumulation of an amplitude level per unit of time of a signal with a frequency exceeding the predetermined frequency increases with progression of bars; and a lighting control data generating unit configured to generate lighting control data based on the transition information obtained by the transition information acquisition unit and the level-varying section detected by the level-varying-section analyzing unit.

5. The lighting controller according to claim 4, wherein the lighting control data generating unit is configured to set a starting point of the detected level-varying section as a changing point of a lighting effect.

6. A computer-readable medium that stores a program code configured to enable a computer to function as the lighting controller according to claim 4 when read and run by the computer.

7. A lighting controller configured to control a lighting fixture based on music piece data in which characteristic sections that characterize a music construction are allocated, the lighting controller comprising:

a transition information acquisition unit configured to obtain transition information for each of the characteristic sections in the music piece data;

a fill-in-section analyzing unit configured to analyze at least one of the characteristic sections in the music piece data to detect a fill-in section where a peak level of a signal detected per beat varies; and a lighting control data generating unit configured to generate lighting control data based on the transition information obtained by the transition information acquisition unit and the fill-in section detected by the fill-in-section analyzing unit.

8. The lighting controller according to claim 7, wherein the lighting control data generating unit is configured to set a starting point of the detected fill-in section as a changing point of a lighting effect.

9. A computer-readable medium that stores a program code configured to enable a computer to function as the lighting controller according to claim 7 when read and run by the computer.

10. A lighting control method of controlling a lighting fixture based on music piece data in which characteristic sections that characterize a music construction are allocated, the method comprising:

obtaining, by a transition information acquisition unit, transition information for each of the characteristic sections in the music piece data;

analyzing, by a note-fractionated-section analyzing unit, at least one of the characteristic sections in the music piece data to detect a note-fractionated section where a note interval is fractionated with progression of bars by analyzing a rhythm pattern of a note; and generating, by a lighting control data generating unit, lighting control data based on the obtained transition information and the detected note-fractionated section.

11. A lighting control method of controlling a lighting fixture based on music piece data in which characteristic sections that characterize a music construction are allocated, the method comprising:

obtaining, by a transition information acquisition unit, transition information for each of the characteristic sections in the music piece data;

analyzing, by a level-varying-section analyzing unit, at least one of the characteristic sections in the music piece data to detect a level-varying section where accumulation of an amplitude level per unit of time of a signal with a predetermined frequency or less falls within a predetermined range and accumulation of an amplitude level per unit of time of a signal with a frequency exceeding the predetermined frequency increases with progression of bars; and generating, by a lighting control data generating unit, lighting control data based on the obtained transition information and the detected level-varying section.

12. A lighting control method of controlling a lighting fixture based on music piece data in which characteristic sections that characterize a music construction are allocated, the method comprising:

obtaining, by a transition information acquisition unit, transition information for each of the characteristic sections in the music piece data;

analyzing, by a fill-in-section analyzing unit, at least one of the characteristic sections in the music piece data to detect a fill-in section where a peak level of a signal detected per beat varies; and generating, by a lighting control data generating unit, lighting control data based on the obtained transition information and the detected fill-in section.

* * * * *